US011026867B2

(12) United States Patent
Smith et al.

(10) Patent No.: US 11,026,867 B2
(45) Date of Patent: Jun. 8, 2021

(54) BABY BOTTLE

(71) Applicant: TOMY INTERNATIONAL, INC., Dyersville, IA (US)

(72) Inventors: Collin Smith, Gilbert, AZ (US); Casey L. Moore, Mesa, AZ (US); Kathryn Wozniak, Tempe, AZ (US); Leda Belden, Chandler, AZ (US); Hideo Tone, Chandler, AZ (US)

(73) Assignee: TOMY INTERNATIONAL, INC., Dyersville, IA (US)

( * ) Notice: Subject to any disclaimer, the term of this patent is extended or adjusted under 35 U.S.C. 154(b) by 101 days.

(21) Appl. No.: 16/150,971

(22) Filed: Oct. 3, 2018

(65) Prior Publication Data

US 2019/0110956 A1 Apr. 18, 2019

Related U.S. Application Data

(60) Provisional application No. 62/572,929, filed on Oct. 16, 2017.

(51) Int. Cl.

| | |
|---|---|
| ***A61J 9/00*** | (2006.01) |
| ***A61J 9/08*** | (2006.01) |
| ***A61J 11/04*** | (2006.01) |
| ***A61J 9/06*** | (2006.01) |
| ***A61J 11/00*** | (2006.01) |

(52) U.S. Cl.

CPC ..... *A61J 9/001* (2013.01); *A61J 9/06* (2013.01); *A61J 9/08* (2013.01); *A61J 11/0085* (2013.01); *A61J 11/04* (2013.01); *A61J 11/045* (2013.01); *A61J 2200/76* (2013.01)

(58) Field of Classification Search

CPC ..... A61J 9/001; A61J 9/06; A61J 2200/76

See application file for complete search history.

(56) References Cited

U.S. PATENT DOCUMENTS

| | | | | | |
|---|---|---|---|---|---|
| 2,110,928 | A * | 3/1938 | De Buys | A61J 9/001 | 215/11.6 |
| 3,161,311 | A * | 12/1964 | Boston | A61J 9/001 | 215/11.3 |
| 3,664,535 | A * | 5/1972 | Mette | A61J 9/001 | 215/11.1 |
| 4,238,040 | A * | 12/1980 | Fitzpatrick | A61J 9/001 | 215/11.3 |
| 5,617,972 | A * | 4/1997 | Morano | B65D 1/265 | 221/33 |

(Continued)

*Primary Examiner* — James N Smalley
*Assistant Examiner* — Jennifer Castriotta
(74) *Attorney, Agent, or Firm* — Lando & Anastasi, LLP

(57) ABSTRACT

A container assembly includes a container body, a container capable of being received within the container body, and a collar. The container body includes an upper end having a first compression surface. The container includes a first flange configured to engage the first compression surface. The collar is capable of being releasably secured to the container body. The collar includes a second compression surface. A dispensing portion includes a second flange configured to engage the second compression surface. When securing the collar to the container body, the first compression surface engages the first flange and the second compression surface engages the second flange to cause the first flange to sealingly engage the second flange.

16 Claims, 8 Drawing Sheets

(56) References Cited

U.S. PATENT DOCUMENTS

| | | | | |
|---|---|---|---|---|
| 9,708,098 | B2 † | 7/2017 | Plott | |
| 2010/0193460 | A1 * | 8/2010 | Driver | A61J 9/001 215/11.3 |

* cited by examiner
† cited by third party

BABY BOTTLE

CROSS REFERENCE TO RELATED APPLICATION

This application claims priority under 35 U.S.C. § 119(e) to U.S. Provisional Application Ser. No. 62/572,929 titled "BABY BOTTLE," filed on Oct. 16, 2017, which is incorporated herein by reference in its entirety.

BACKGROUND OF THE DISCLOSURE

The present disclosure relates generally to re-sealable bottles, and more particularly to a re-sealable bottle for feeding a baby.

SUMMARY OF DISCLOSURE

One aspect of the present disclosure is directed to a container assembly. In some embodiments the container assembly comprises a container body including an upper end having a first compression surface; a container capable of being received within the container body, the container including a first flange configured to engage the first compression surface; a collar capable of being releasably secured to the container body, the collar including a second compression surface; and a dispensing portion including a second flange configured to engage the second compression surface, wherein, when securing the collar to the container body, the first compression surface engages the first flange and the second compression surface engages the second flange to cause the first flange to sealingly engage the second flange.

In some embodiments, the first flange has a first lower surface and a first upper surface, the first lower surface being capable of engaging the first compression surface when the container is received within the container body.

In some embodiments, the second flange has a second lower surface and a second upper surface, the second compression surface being capable of engaging the second upper surface.

In some embodiments, the first lower surface is in direct engagement with the first compression surface, the second upper surface is in direct engagement with the second compression surface, and the first upper surface and the second lower surface are in sealing engagement when the collar is secured to the container body and the first flange sealingly engages the second flange.

In some embodiments, the first upper surface is flat and the second lower surface is flat.

In some embodiments, the first flange is annular, the first flange including a lip extending downwardly from the first lower surface.

In some embodiments, the container body includes a lip, the lip including at least a portion of the compression surface, the lip extending above an upper surface of the container body.

In some embodiments, the second flange is annular, the second flange including an upwardly extending lip.

In some embodiments, the collar includes a downwardly extending lip that is positioned radially inward with respect to the upwardly extending lip of the second flange when the collar is secured to the container body.

In some embodiments, the container assembly further comprises a cap including an inner annular surface, the collar including an outer annular surface configured to frictionally engage the inner annular surface to secure the cap to the collar.

In some embodiments, the container assembly further comprises a cap including a lower cap surface, the collar including a stop surface to limit downward movement of the lower cap surface relative to the collar.

In some embodiments, the container body includes a side wall, and at least one aperture is defined in the side wall.

In some embodiments, the container includes a plurality of graduated markings that are visible through at least one aperture of the at least one aperture.

In some embodiments, the dispensing portion includes a nipple and a nipple opening defined in the nipple.

In some embodiments, the container is made of silicone.

In some embodiments, the dispensing portion is made of silicone.

In some embodiments, the container body includes external threads and the collar includes internal threads.

BRIEF DESCRIPTION OF THE DRAWINGS

Various aspects of at least one embodiment are discussed below with reference to the accompanying figures, which are not intended to be drawn to scale. Where technical features in the figures, detailed description or any claim are followed by references signs, the reference signs have been included for the sole purpose of increasing the intelligibility of the figures, detailed description, and claims. Accordingly, neither the reference signs nor their absence are intended to have any limiting effect on the scope of any claim elements. In the figures, each identical or nearly identical component that is illustrated in various figures is represented by a like numeral. For purposes of clarity, not every component may be labeled in every figure. The figures are provided for the purposes of illustration and explanation and are not intended as a definition of the limits of the disclosure. In the figures:

DETAILED DESCRIPTION

Figure 1:
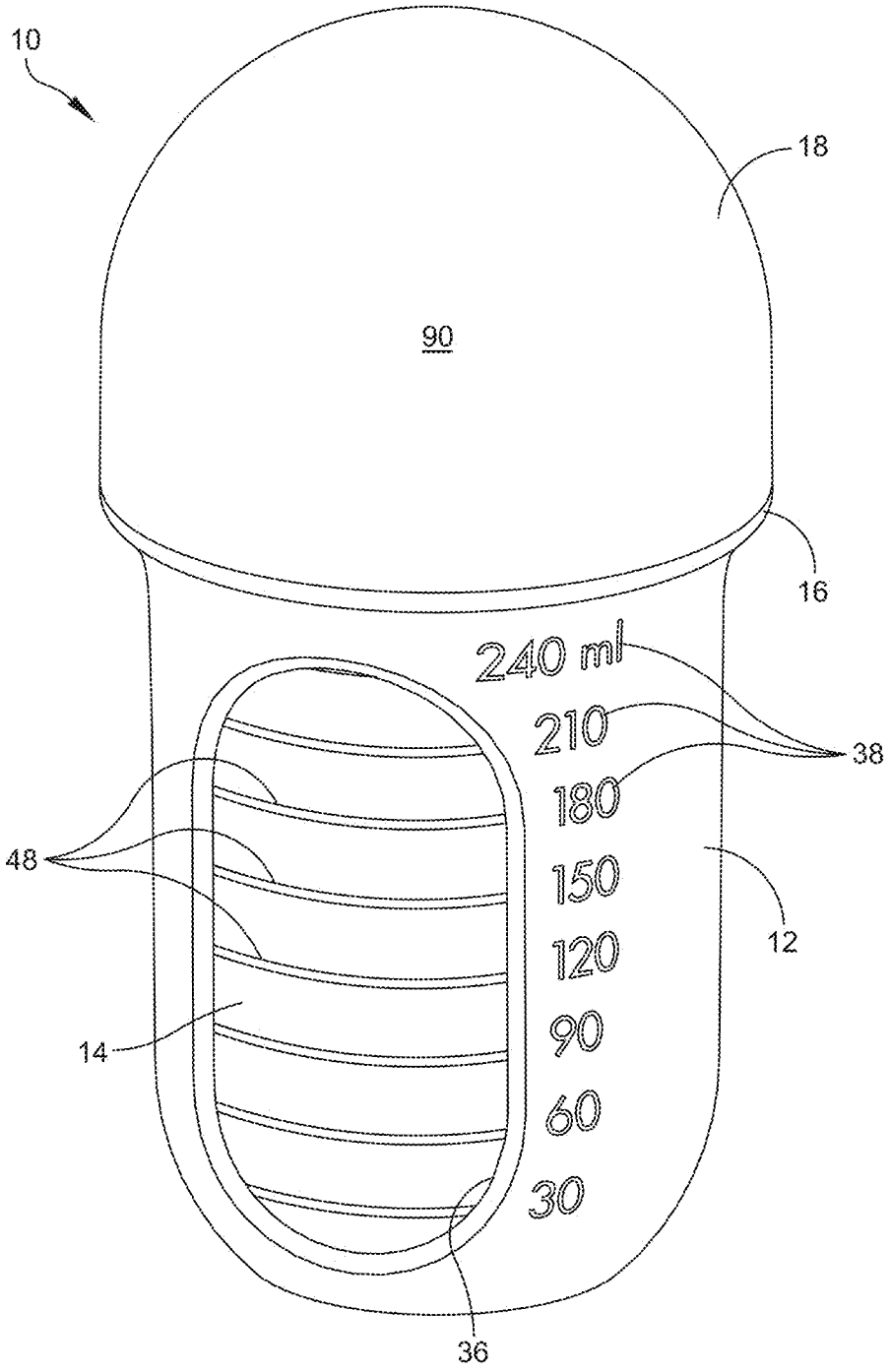
FIG. 1 shows a perspective view of a container assembly according to an embodiment of the present disclosure.

The present disclosure is directed to a container assembly that is configured to provide a re-sealable enclosure so the container assembly can be used as a baby bottle. The container assembly can also be used as a toddler bottle as well.

According to one aspect of the present disclosure, a container assembly is provided. The container assembly is useful for containing fluids. The container assembly is particularly useful for containing consumable products, such as milk or liquid formula for infants.

In some embodiments, the container assembly includes a container body, a container capable of being received within the container body, a dispensing portion, and a collar capable of being secured to the container body.

The container body supports the container, which is nested within the container body when the container assembly is fully assembled. In some embodiments, the container body is formed of a rigid plastic. The container body includes a lip at the upper end of the container body for facilitating alignment of the container within the container body.

The container includes a flange that has a lip, which is configured to align the container with the container body. When the container is properly seated within the container body, the lip of the container extends around a periphery of the lip of the container body.

In some embodiments, the container is made of a relatively flexible material compared to the container body. In some embodiments, the container is made of silicone. In some embodiments, the container is translucent. In some embodiments, the container is transparent.

The container is useful for containing an edible product. A user can insert a desired amount of fluid into the container. In some embodiments, to help a user determine the amount of fluid within the container, the container includes graduated markings. In some embodiments, the graduated markings are printed and/or molded on an outer surface of a side wall of the container. In some embodiments, the graduated markings are printed and/or molded on an inner surface of the side wall of the container. The container may have a capacity of 120 milliliters, 240 milliliters, or other volumes.

In some embodiments, the container includes a flange for engaging the dispensing portion. In some embodiments, the upper surface of the flange of the container is flat. In other embodiments, the upper surface of the flange may have another surface profile that is useful for sealing the container against the dispensing portion to form a sealed enclosure.

Once a user inserts a desired amount of fluid into the container, the user places the dispensing portion on the container. When the container assembly is fully assembled, the container interacts with the dispensing portion to form an airtight seal, so contents within the container can only be dispensed through the dispensing portion.

To dispense contents from the container assembly, the dispensing portion includes a nipple having a nipple opening. In some embodiments, the nipple and nipple opening may be dimensioned and configured as needed to provide a structure that is useful for dispensing an edible liquid product to a child. For example, the dispensing portion may be used to dispense milk or liquid formula from the sealed enclosure to a child. In some embodiments, the dispensing portion is useful for dispensing a food product.

The flange of the dispensing portion includes a lip, which facilitates alignment with the collar.

In some embodiments, the dispensing portion is made of latex, silicone, or the like. In some embodiments, the dispensing portion is translucent. In some embodiments, the dispensing portion is transparent.

As noted above, the dispensing portion interacts with the container to form an airtight seal. In some embodiments, the dispensing portion includes a flange. In some embodiments, the lower surface of the flange of the dispensing portion is flat. In other embodiments, the lower surface of the flange may have another surface profile that is useful for sealing the dispensing portion against the container to form a sealed enclosure.

A collar can be secured, for example by threads, to the container body. The collar and the container body can be tightened together to compress a surface of the dispensing portion against a surface of the container. The collar includes a lip, which interacts with the lip of the flange of the dispensing portion to facilitate alignment of the collar with the dispensing portion.

To assemble the container assembly, a user first places the container within the container body. The lip of the container and the lip of the container body facilitate alignment of the container with the container body. Next, the user places the dispensing portion within the collar. The lip of the collar and the lip of the dispensing portion facilitate alignment of the dispensing portion with the collar. Next, the user places the sub-assembly of the dispensing portion and the collar on the sub-assembly of the container and the container body so that a surface on the flange of the dispensing portion is in adjacent facing relation to a surface on the flange of the container. Then the user can secure the collar to the container body to form a seal between the surface of the flange of the dispensing portion and the surface of the flange of the container. For example, in embodiments in which the collar is threadably securable to the container body, the user may secure the collar to the container body by screwing the collar onto the container body. When the collar is secured to the container body, the collar and the container body press the flange of the container against the flange of the dispensing portion. In some embodiments, the seal between the dispensing portion and the container is an airtight seal. Together the container and the dispensing portion form a sealed enclosure, and a liquid contained in the sealed enclosure can only be dispensed from the sealed enclosure through the dispensing portion.

Practically speaking, because the lip of the collar and the lip of the dispensing portion facilitate alignment of the collar and the dispensing portion, a user may insert the dispensing portion into the collar before securing the collar to the container body.

The cap is securable to the collar to protect the dispensing portion, in particular, the nipple of the dispensing portion, when the container assembly is not in use. In some embodiments, the cap may be securable to the collar by a snap fit or a friction fit. In some embodiments, the cap may be threadably securable to the collar. In some embodiments, an outer cap surface is substantially hemispherical or entirely hemispherical.

Referring now to the drawings, FIG. 1 shows a perspective view of an embodiment of a container assembly, generally indicated at 10, that includes a container body 12 and a container 14 received within the container body 12. A collar 16 is threadably secured to the container body 12. A cap 18 is releasably secured to the collar 16.

Figure 2:
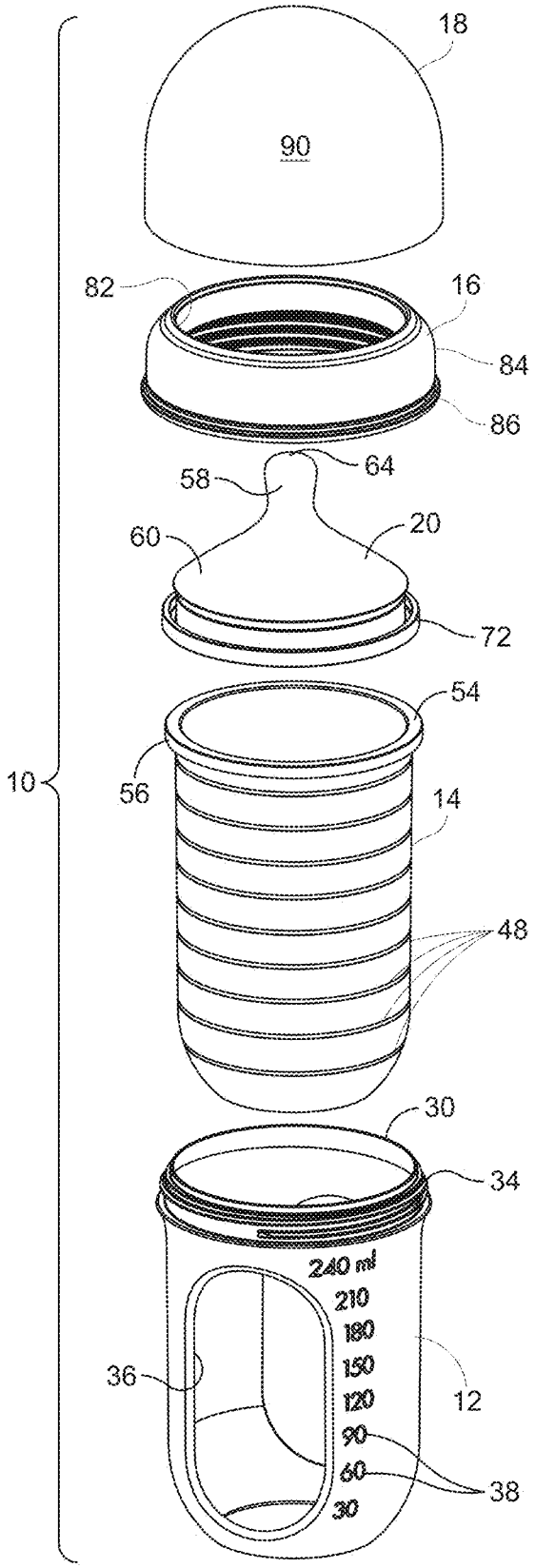
FIG. 2 shows an exploded perspective view of the container assembly of FIG. 1.

FIG. 2 shows an exploded perspective view of the embodiment of the container assembly 10 of FIG. 1.

As shown in FIG. 2, the container assembly 10 includes a dispensing portion 20 for dispensing a product, such as a consumable liquid from the container assembly 10. In certain embodiments, the consumable liquid may include, but is not limited to, baby formula, milk, breast milk, water, juices, and the like. The dispensing portion 20 is securable to the container 14 by the collar 16, when the collar 16 is threadably secured to the container body 12, as described in more detail below. To assemble the container assembly 10, a user places the container 14 within the container body 12. Next, the user places the dispensing portion 20 within the collar 16. As discussed below, a lip of the collar and a lip of the dispensing portion facilitate alignment of the dispensing portion 20 with the collar 16. Then the user places the sub-assembly of the collar 16 and the dispensing portion 20 over the container 14. Then the user secures the collar 16 to the container body 12, thereby forming a seal between the dispensing portion 20 and the container 14. The user places the cap 18 over the collar 16 when the user does not wish to dispense a product from the container. A user can disassemble the container assembly 10 for cleaning, and for convenient refilling of the sealed enclosure of the container assembly 10.

Figure 3:
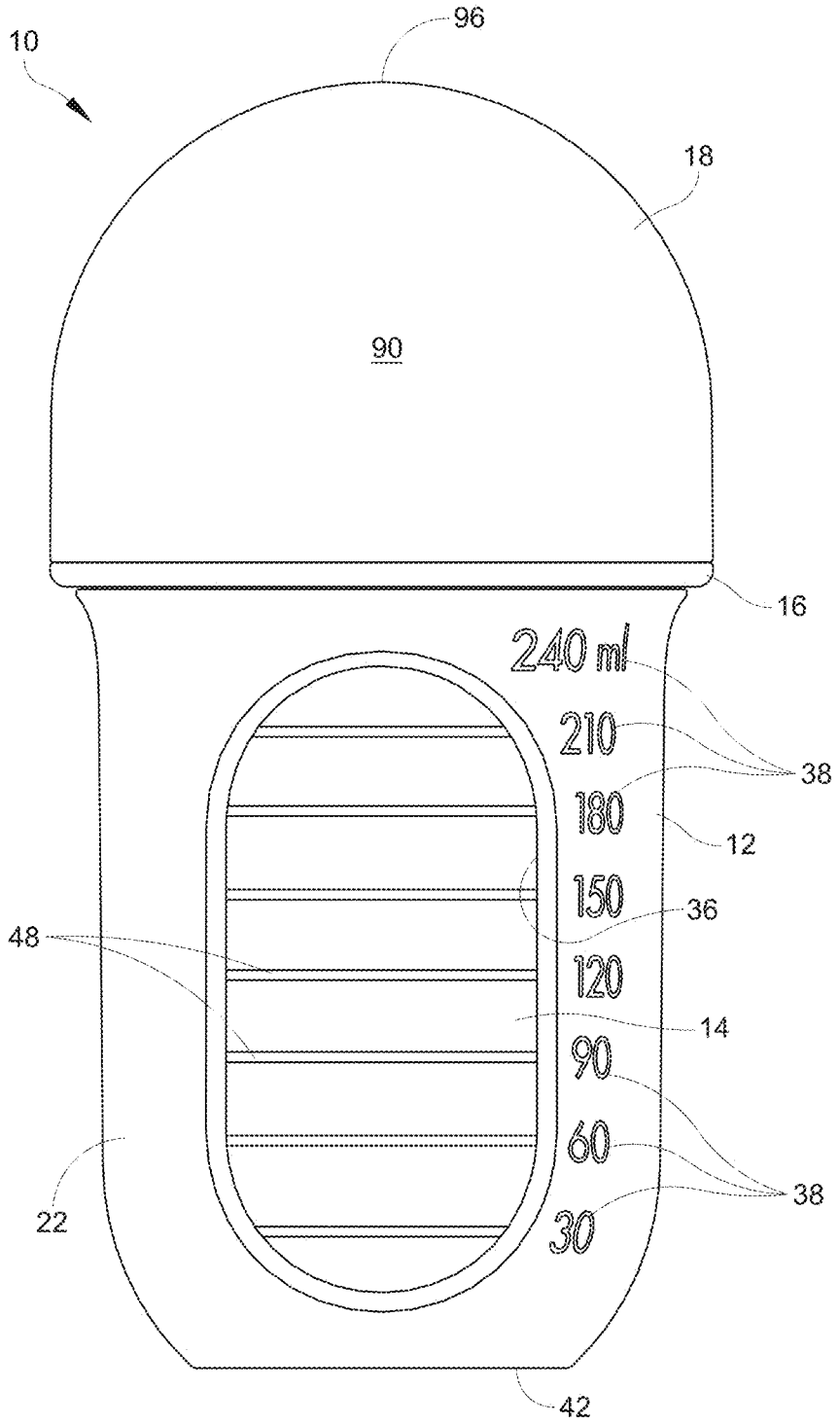
FIG. 3 shows a front elevational view of the container assembly of FIG. 1.
Figure 4:
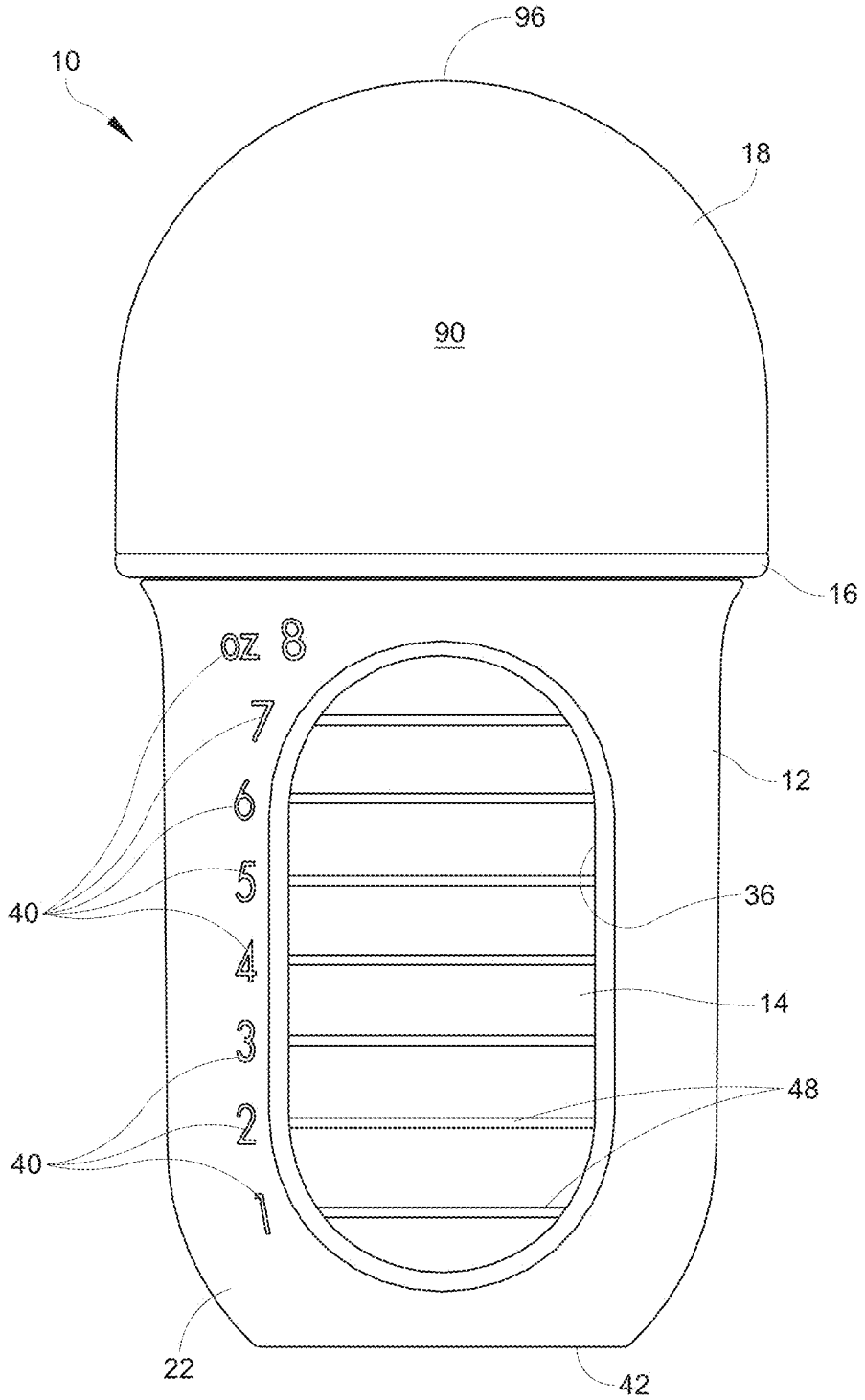
FIG. 4 shows a rear elevational view of the container assembly of FIG. 1.
Figure 5:
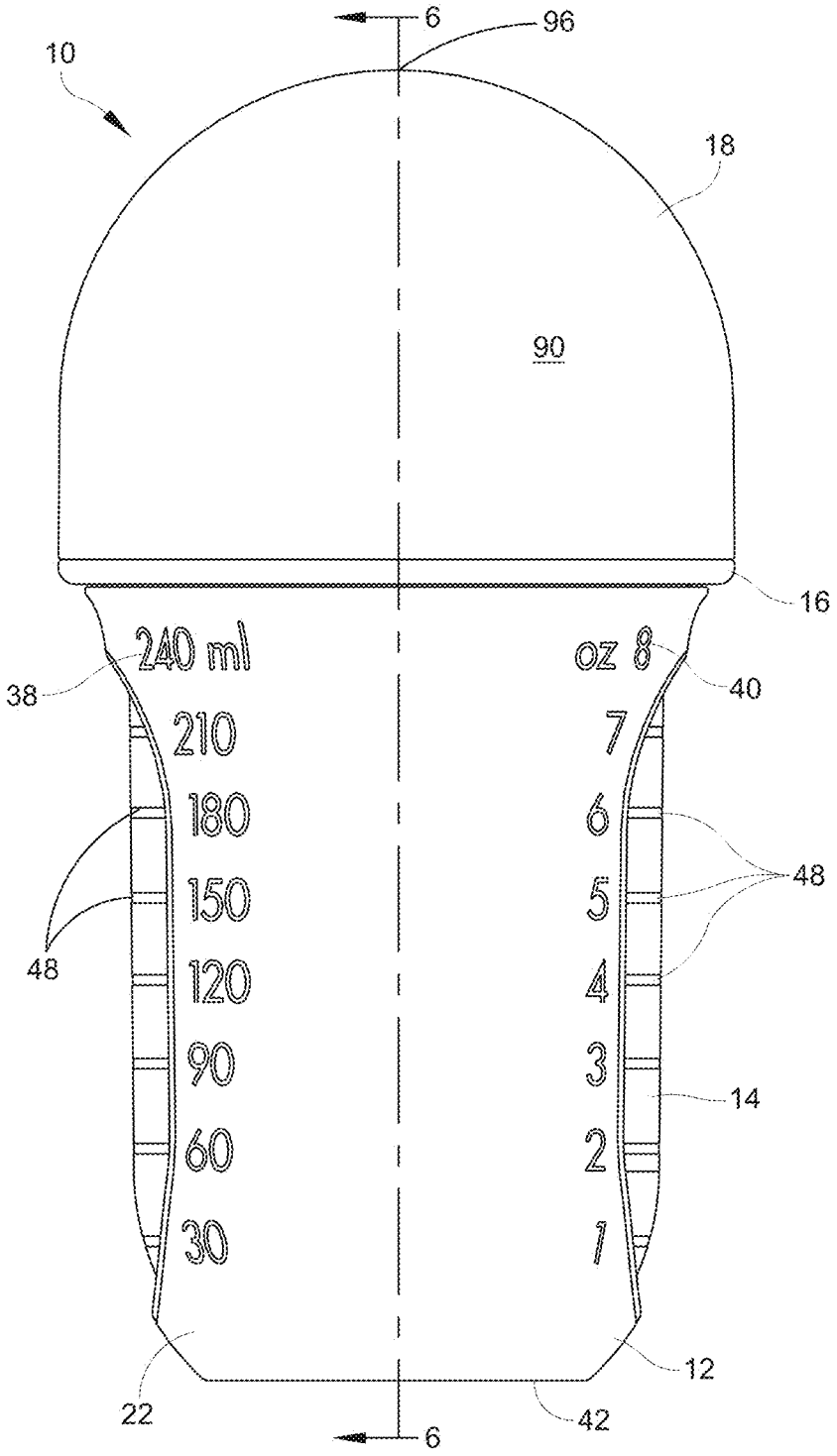
FIG. 5 shows a side elevational view of the container assembly of FIG. 1.

FIG. 3 shows a front elevational view of the embodiment of the container assembly 10 of FIG. 1. FIG. 4 shows a rear elevational view of the container assembly 10. FIG. 5 shows a side elevational view of the container assembly 10. As shown in FIG. 1 and FIGS. 3-5, the cap 18 covers the dispensing portion 20.

Figure 6:
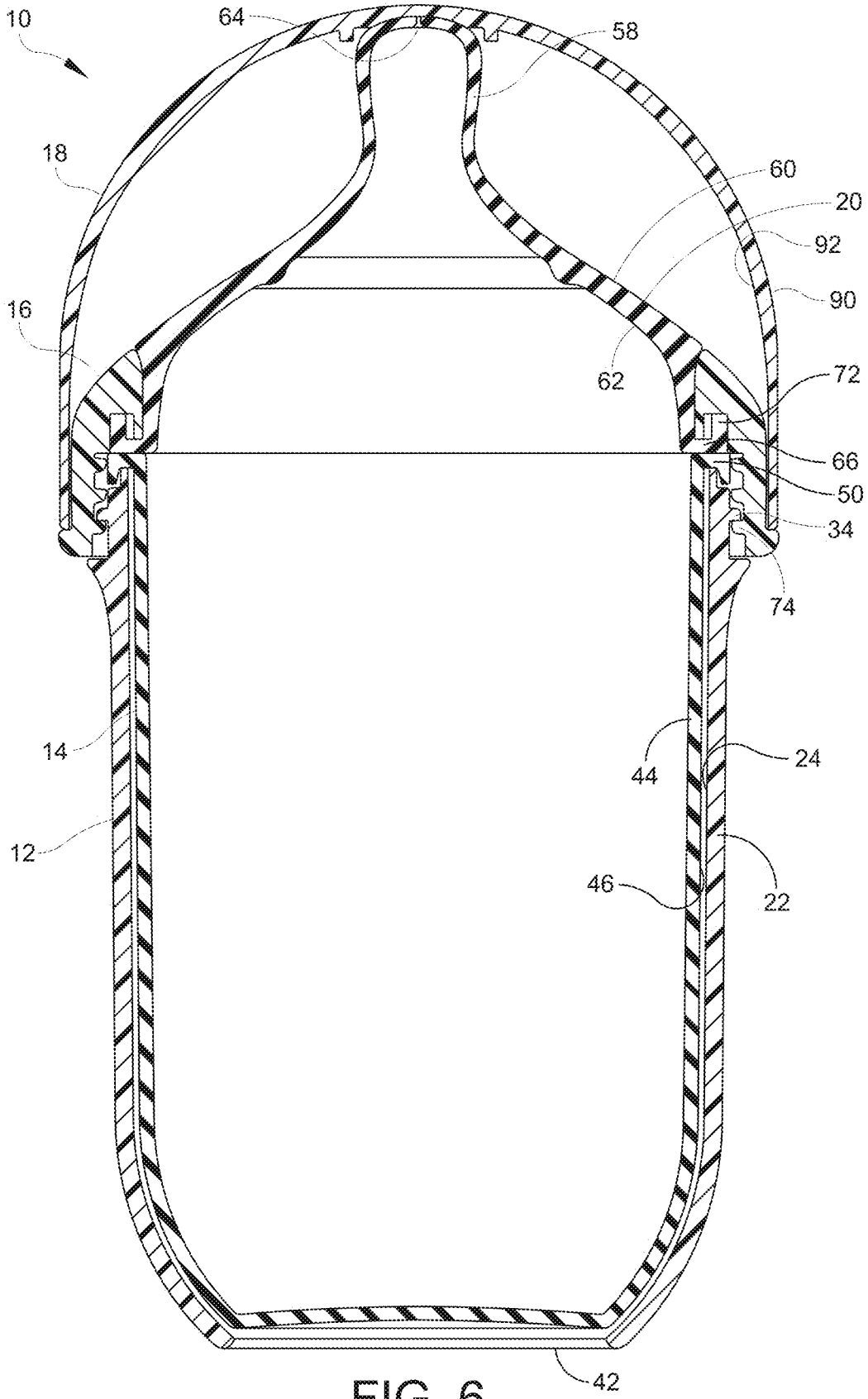
FIG. 6 shows a cross-sectional view of the container assembly of FIG. 1, through the line 6-6 of FIG. 5.
Figure 7:
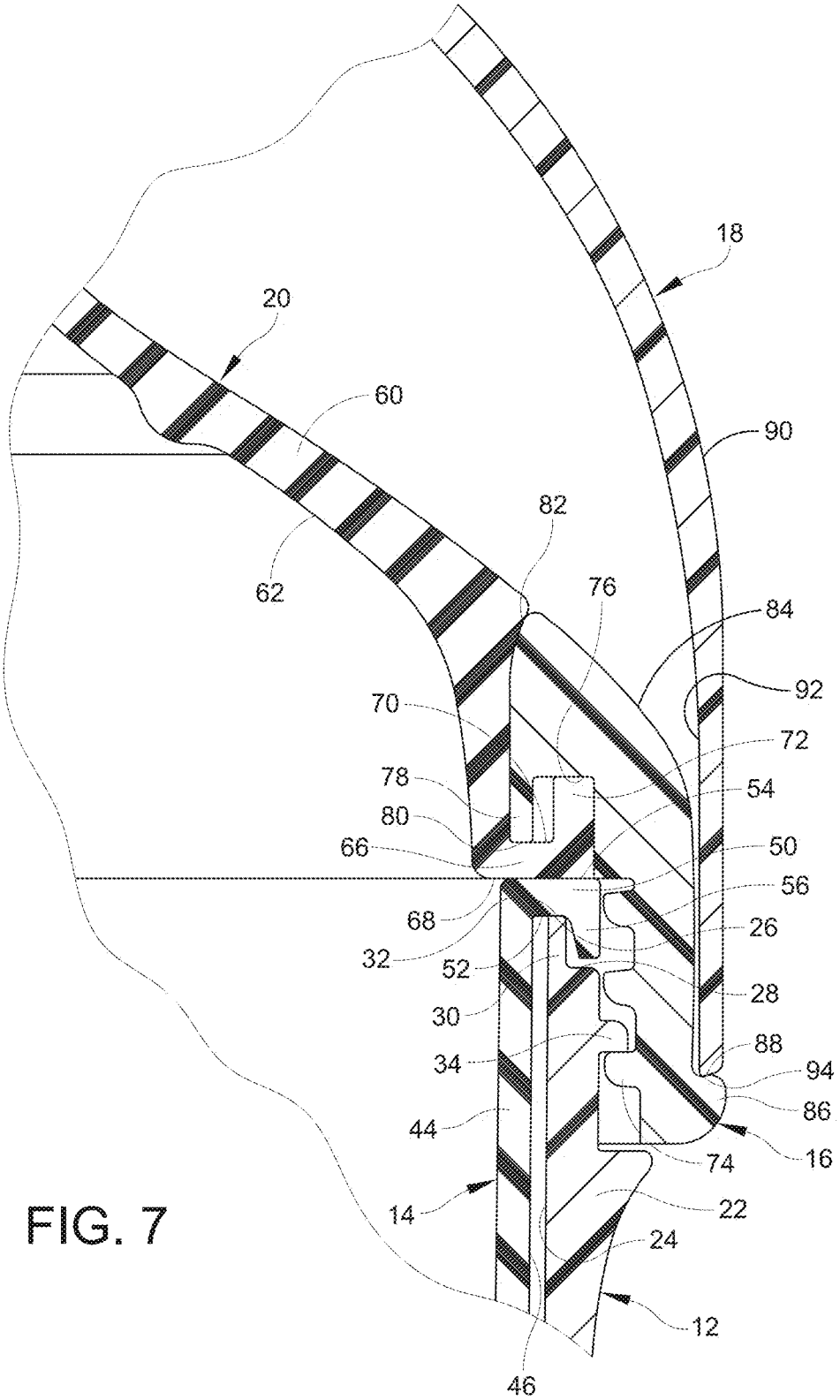
FIG. 7 shows an enlarged view of a portion of FIG. 6.

FIG. 6 shows a cross-sectional view of the container assembly of FIGS. 1-5 through the line 6-6 in FIG. 5. FIG. 7 shows an enlarged portion of FIG. 6.

The container body 12 provides structural support to the container 14 when the container 14 is received in the container body 12.

The container body 12 includes a side wall 22. An inner surface 24 of the side wall 22 defines a cavity into which a user can place the container 14.

The container body 12 includes an upper end 26 that has an upper surface 28. FIG. 7 shows that the container body 12 includes a lip 30 at its upper end 26. The lip 30 extends above the upper surface 28. The lip 30 has a compression surface 32 that is configured for supporting a container that is received within the container body 12. The compression surface 32 is configured to sealingly engage the container, as described in further detail below.

In some embodiments, the upper surface 28 is configured to sealingly engage the container, for example, by engaging a flange lip of a first flange of the container.

The upper end 26 of the container body 12 includes external threads 34. The external threads 34 on the container body 12 allow a user to threadably secure the collar 16 to the container body 12 by internal threads associated with the collar. The construction of the collar 16 is discussed in further detail below.

At least one aperture is formed in the side wall 22, each aperture defined by an aperture edge 36 on the side wall 22 of the container body 12. In the container assembly 10 of FIGS. 1-7, the container body 12 includes two apertures, each defined by a respective aperture edge 36 in the side wall 22 of the container body 12. The apertures are sufficiently large so that a user can see contents, such as a fluid, within a container that is supported in the container body 12.

In some embodiments, the side wall 22 of the container body 12 includes a pattern of apertures to allow a user to view the contents within a container supported within the container body. In some embodiments, the side wall 22 of the container body 12 includes a textured surface to help a user grip the container body 12.

Fluid level markings are adjacent to at least one aperture on the side wall 22 of the container body 12, and show the volume of a liquid in the container that is supported within the container body 12. A first set of fluid level markings 38 show fluid volumes of 30 milliliters, 60 milliliters, 90 milliliters, 120 milliliters, 150 milliliters, 180 milliliters, 210 milliliters, 240 milliliters. A second set of fluid level markings 40 show fluid volumes of 1 ounce, 2 ounces, 3 ounces, 4 ounces, 5 ounces, 6 ounces, 7 ounces, and 8 ounces.

A lower end 42 of the container body 12 forms a lower end of the container assembly 10.

The container 14, as discussed above and shown in the drawings, is capable of being received within the container body 12.

The container 14 includes a side wall 44 that has an outer surface 46. The outer surface 46 of the side wall 44 of the container 14 is in spaced apart facing relation with the inner surface 24 of the side wall 22 of the container body 12. In some embodiments, the outer surface 46 of the side wall 44 of the container 14 may be in directly adjacent relation to the inner surface 24 of the side wall 22 of the container body 12.

The container 14 includes a plurality of graduated markings 48 that are visible through at least one of the apertures defined in the side wall 22 of the container body 12. The graduated markings 48 are aligned with one or more set of fluid level markings 38, 40 on the container body 12. The graduated markings 48 are printed on the outer surface 46 of the side wall 44 of the container 14.

The container 14 includes a flange (a first flange) 50 that extends over the upper end 26 of the container body 12 when the container 14 is received within the cavity of the container body 12. The flange 50 of the container 14 includes a lower surface (a first lower surface) 52 and an upper surface 54 (a first upper surface). The flange 50 of the container 14 is configured to engage the first compression surface 32. In some embodiments, the first lower surface 52 is capable of engaging the first compression surface 32 when the container 14 is received within the container body 12. FIG. 7 shows the lower surface 52 of the flange 50 in direct engagement with the first compression surface 32 of the container body 12.

In the embodiment of FIGS. 1-7, the first flange 50 is annular in construction. In the embodiment of FIGS. 1-7, the first lower surface 52 is flat. In the embodiment of FIGS. 1-7, the first upper surface 54 is flat.

The first flange 50 includes a flange lip 56 that is positioned radially outwardly with respect to the lip 30 of the container body 12 when the container 14 is received in the container body 12. Together, the flange lip 56 of the container 14 and the lip 30 of the container body 12 help to align the container 14 with the container body 12 when a user places the container 14 into the container body 12.

The dispensing portion 20, when the container assembly 10 is fully assembled, is seated above the container 14, and the dispensing portion 20 and container 14 are in sealing engagement to form a sealed enclosure. The dispensing portion 20 includes a nipple 58 at the upper end of the dispensing portion. The nipple 58 extends upwardly from a frustoconical wall 60 of the dispensing portion. When the container assembly 10 is inverted and a fluid is within the sealed enclosure of the container assembly, an inner surface 62 of the frustoconical wall 60 guides the fluid toward the nipple 58, so that the fluid may be dispensed from the nipple 58. To dispense a fluid from the nipple 58, a nipple opening 64 is defined in the nipple 58.

The dispensing portion 20 includes a flange 66 (a second flange). The flange 66 is configured to engage the flange 50 of the container 14. The flange 66 has a lower surface 68 and an upper surface 70 (a second upper surface). The lower surface 68 of the second flange 66 is configured to directly engage the upper surface 54 of the first flange 50. The lower surface 68 of the second flange 66 can be pressed against the upper surface 54 of the first flange 50 to form a seal between the container 14 and the dispensing portion 20. When the lower surface 68 of the second flange 66 is in sealing engagement with the upper surface 54 of the first flange 50, fluid in the container 14 can only be dispensed through the nipple opening 64.

In FIG. 7, the second flange 66 is annular in construction and the lower surface 68 of the second flange 66 is flat.

The flange 66 of the dispensing portion 20 is also configured to engage the collar 16. The flange 66 includes an upwardly extending lip 72 to facilitate alignment of the dispensing portion 20 with the collar 16. The upper surface 70 of the flange 66 is capable of being in direct engagement with a compression surface on the collar 16.

The collar 16, as shown in FIG. 7, is threadably (and releasably) secured to the container body 12. As mentioned above, the collar 16 of FIG. 7 includes internal threads 74 that threadably engage the external threads 34 on the container body 12 in FIG. 7.

The collar 16 includes a lower surface 76 that faces downwardly from the collar 16. In FIG. 7, the lower surface 76 of the collar is in direct engagement with the lip 72, which helps to press the flange 66 of the dispensing portion 20 in sealing engagement with the flange 50 of the container 14.

The collar 16 includes a lip 78 that is positioned radially inwardly with respect to the lip 72 of the flange 66 of the dispensing portion 20 when the collar 16 is secured to the container body 12 to seal the dispensing portion 20 to the container 14.

The collar 16 includes a compression surface 80 (a second compression surface) that is configured to engage the flange 66 of the dispensing portion 20 to cause the flange 50 of the container 14 to sealingly engage the flange 66 of the dispensing portion 20.

At an upper end of the collar 16, the collar 16 includes a rim 82 that defines an aperture. The rim 82 is dimensioned to receive the frustoconical wall 60 of the dispensing portion 20 when the collar 16 secures the dispensing portion 20 to the container body 12. As shown, the nipple 58 of the dispensing portion 20 extends above the rim 82 of the collar 16.

The collar 16 includes an outer annular surface 84 that can support the cap 18. The collar 16 includes an annular stop 86 that protrudes from the outer annular surface 84 of the collar 16. The annular stop 86 includes a stop surface 88 that is configured to limit downward movement of the cap relative to the collar 16 when securing the cap to the collar 16, as discussed in more detail below.

In FIG. 7, the container body 12 and the collar 16 are positioned about the container 14 and the dispensing portion 20 to press the flange 50 of the container 14 against the flange 66 of the dispensing portion 20 to form a seal at the interface of the flange 50 of the container 14 and the flange 66 of the dispensing portion 20.

Together, the collar 16, the container body 12, the container 14, and the dispensing portion 20 can be assembled to form an airtight seal between the container 14 and the dispensing portion 20. To assemble the container assembly 10, first a user positions the container 14 within the container body 12. Then the user fills the container 14 to a desired level by pouring a product into the container 14 and comparing the fluid level to the graduated markings 48 on the container 14. Next, the user places the dispensing portion 20 within the collar 16. The lip of the collar and the lip of the dispensing portion facilitate alignment of the dispensing portion with the collar. Next, the user places the sub-assembly of the dispensing portion 20 and the collar 16 on the sub-assembly of the container 14 and the container body 12 so that the upper surface 54 of the flange 50 of the container 14 and the lower surface 68 of the flange 66 of the dispensing portion 20 are in direct facing engagement. Then the user rotates the collar 16 relative to the container body 12 to engage the internal threads 74 of the collar 16 with the external threads 34 of the container body 12.

When the user secures the collar 16 to the container body 12, the compression surface 32 (first compression surface) of the container body 12 engages the flange 50 (the first flange) of the container 14, and the compression surface 80 (the second compression surface) of the collar 16 engages the flange 66 (the second flange) of the dispensing portion 20 to cause the flange 50 to sealingly engage the flange 66, such that there is an airtight seal at the interface of the lower surface 68 of the flange 66 and the upper surface 54 of the flange 50.

When the collar 16 is tightened to the container body 12, the lower surface 52 of the first flange 50 is in directly facing sealing engagement with the first compression surface 32. The upper surface 70 of the second flange 66 is in directly facing sealing engagement with the second compression surface 80.

A user may secure the cap 18 to the collar 16 when the sealed enclosure of the container assembly 10 is used to store or transport a product. The cap is secured to the collar by a frictional fit. A user may remove the cap 18 from the collar 16 when the user is ready to dispense a product from the sealed enclosure of the container assembly 10.

The cap 18 includes an outer cap surface 90 that is curved. The cap 18 includes an inner annular surface 92 that is configured to engage the outer annular surface 84 of the collar 16.

The inner annular surface 92 of the cap 18 is capable of frictionally engaging the outer annular surface 84 of the collar 16 to secure the cap 18 to the collar 16.

The cap 18 includes a lower cap surface 94 that forms an edge of the cap. The downward movement of the cap 18 relative to the collar 16 is limited by engagement of the lower cap surface 94 with the stop surface 88 on the collar 16 when the cap 18 is in the fully closed position.

An upper end 96 of the cap 18 forms an upper end of the container assembly 10 when the cap 18 is positioned on and releasably secured to the collar 16.

Figure 8:
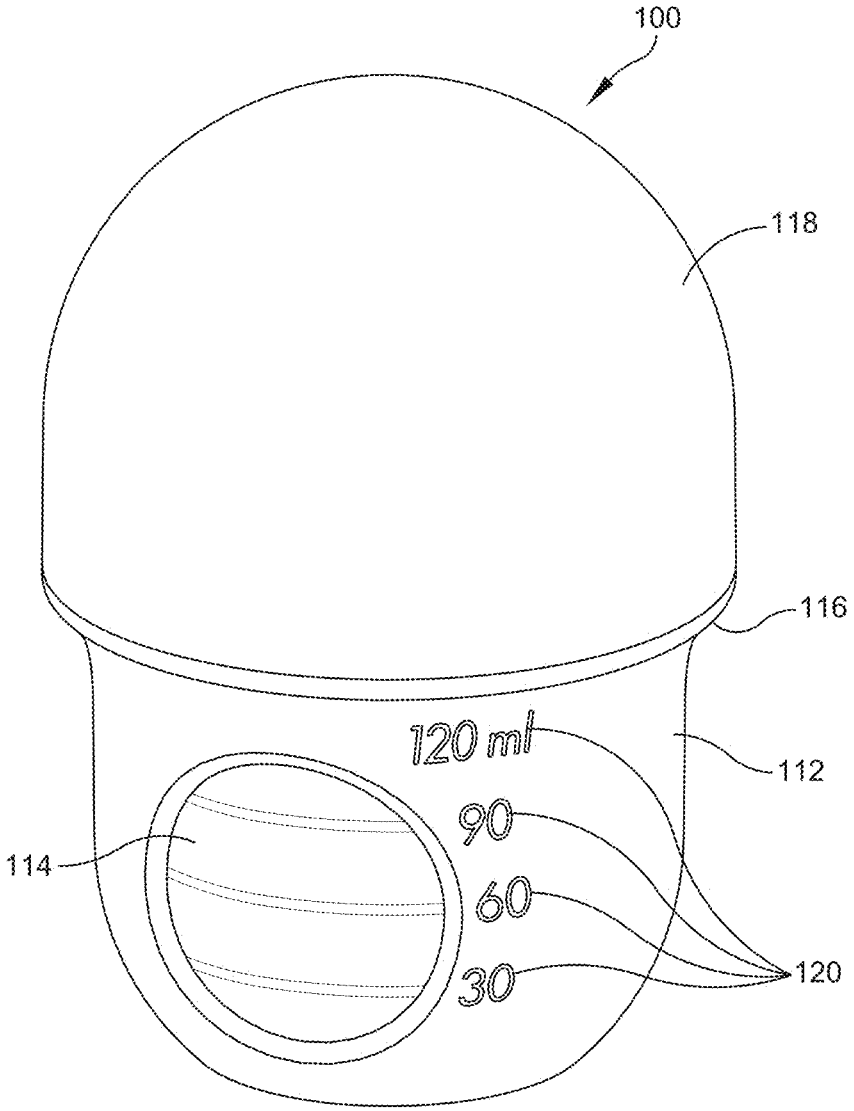
FIG. 8 shows a perspective view of a container assembly according to another embodiment of the present disclosure.

Container assemblies having different shapes and sizes are within the scope of the present disclosure. FIG. 8 shows a perspective view of another embodiment of a container assembly, generally indicated at 100, having a different liquid volume capacity compared to the container assembly 10 of FIGS. 1-7.

The container assembly 100 includes a container body 112 and a container 114 received within the container body 112. A collar 116 is threadably secured to the container body 112. A cap 118 is releasably secured to the collar 116.

The container body 112, the container 114, the collar 116, and the cap 118 function similarly to the container body 12, the container 14, the collar 16, and the cap 18, respectively, which are described above in relation to the container assembly 10.

Fluid level markings 120 are adjacent to at least one aperture on the side wall of the container body 112, and are useful for measuring the volume of a liquid in the container 114. The set of fluid level markings 120 show fluid volumes of 30 milliliters, 60 milliliters, 90 milliliters, and 120 milliliters.

Also, the phraseology and terminology used herein is for the purpose of description and should not be regarded as limiting. Any references to embodiments or elements or acts of the systems and methods herein referred to in the singular may also embrace embodiments including a plurality of these elements, and any references in plural to any embodiment or element or act herein may also embrace embodiments including only a single element. References in the singular or plural form are not intended to limit the presently disclosed systems or methods, their components, acts, or elements. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. Any references to front and back, left and right, top and bottom, upper and lower, and vertical and horizontal are intended for convenience of description, not to limit the present systems and methods or their components to any one positional or spatial orientation.

Having thus described several aspects of at least one embodiment, it is to be appreciated various alterations, modifications, and improvements will readily occur to those skilled in the art. Such alterations, modifications, and improvements are intended to be part of this disclosure and are intended to be within the scope of the disclosure. Accordingly, the foregoing description and drawings are by way of example only, and the scope of the disclosure should be determined from proper construction of the appended claims, and their equivalents.

What is claimed is:

1. A container assembly comprising:

a container body including an upper end having a first compression surface and a first upwardly extending lip;

a container capable of being received within the container body, the container including a first flange configured to engage the first compression surface and a first downwardly extending lip when the container assembly is in a disassembled state, the first downwardly extending lip being configured to align the container with the container body when a user places the container into the container body;

a collar capable of being releasably secured to the container body, the collar including a second compression surface and a second downwardly extending lip; and a dispensing portion including a second flange configured to engage the second compression surface and a second upwardly extending lip;

wherein, when securing the collar to the container body, the first compression surface engages the first flange and the second compression surface engages the second flange to cause the first flange to sealingly engage the second flange, wherein the first upwardly extending lip of the container body has a substantially vertical surface configured to engage a substantially vertical surface of the first downwardly extending lip of the container and the second upwardly extending lip of the dispensing portion has a substantially vertical surface configured to engage a substantially vertical surface of the second downwardly extending lip of the collar when the collar is secured to the container body, wherein the first upwardly extending lip includes at least a portion of the first compression surface and extends above an upper surface of the container body, and wherein the substantially vertical surface of the first downwardly extending lip is positioned radially outward with respect to the substantially vertical surface of the first upwardly extending lip and the at least the portion of the first compression surface.

2. The container assembly of claim 1, wherein the first flange has a first lower surface and a first upper surface, the first lower surface being capable of engaging the first compression surface when the container is received within the container body.

3. The container assembly of claim 2, wherein the second flange has a second lower surface and a second upper surface, the second compression surface being capable of engaging the second upper surface.

4. The container assembly of claim 3, wherein the first lower surface is in direct engagement with the first compression surface, the second upper surface is in direct engagement with the second compression surface, and the first upper surface and the second lower surface are in sealing engagement when the collar is secured to the container body and the first flange sealingly engages the second flange.

5. The container assembly of claim 4, wherein the first upper surface is flat and the second lower surface is flat.

6. The container assembly of claim 4, wherein the first flange is annular and the first downwardly extending lip extends downwardly from the first lower surface.

7. The container assembly of claim 4, wherein the second flange is annular.

8. The container assembly of claim 7, wherein the second downwardly extending lip of the collar is positioned radially inward with respect to the second upwardly extending lip of the dispensing portion when the collar is secured to the container body.

9. The container assembly of claim 1, further comprising a cap including an inner annular surface, the collar including an outer annular surface configured to frictionally engage the inner annular surface to secure the cap to the collar.

10. The container assembly of claim 1, further comprising a cap including a lower cap surface, the collar including a stop surface to limit downward movement of the lower cap surface relative to the collar.

11. The container assembly of claim 1, wherein the container body includes a side wall, and at least one aperture is defined in the side wall.

12. The container assembly of claim 11, the container including a plurality of graduated markings that are visible through at least one aperture of the at least one aperture.

13. The container assembly of claim 1, wherein the dispensing portion includes a nipple and a nipple opening defined in the nipple.

14. The container assembly of claim 1, wherein the container is made of silicone.

15. The container assembly of claim 14, wherein the dispensing portion is made of silicone.

16. The container assembly of claim 1, wherein the container body includes external threads and the collar includes internal threads.

* * * * *